US007276156B2

(12) United States Patent
Lockerman et al.

(10) Patent No.: US 7,276,156 B2
(45) Date of Patent: Oct. 2, 2007

(54) STORM DRAIN FILTER

(76) Inventors: Tony Mason Lockerman, 6320 Gainsborough Dr., Raleigh, NC (US) 27612; Houston Linwood Crumpler, 602 North East Str., Roseboro, NC (US) 28382; John Mills Crumpler, 6102 Tipping Cir., Raleigh, NC (US) 27609

( * ) Notice: Subject to any disclaimer, the term of this patent is extended or adjusted under 35 U.S.C. 154(b) by 234 days.

(21) Appl. No.: 11/138,947

(22) Filed: May 26, 2005

(65) Prior Publication Data

US 2006/0266681 A1 Nov. 30, 2006

(51) Int. Cl.
*E03F 5/14* (2006.01)

(52) U.S. Cl. ..... 210/162; 210/163; 210/170.03; 210/498

(58) Field of Classification Search ..... 210/162, 210/163, 164, 170, 459, 498, 299, 170.03; 404/4, 5
See application file for complete search history.

(56) References Cited

U.S. PATENT DOCUMENTS 316,578 A * 4/1885 Schumann ..... 210/162
1,693,977 A * 12/1928 Egan ..... 210/163
2,986,232 A * 5/1961 Wiley ..... 210/459
3,945,746 A 3/1976 Bredbenner
4,689,145 A * 8/1987 Mathews et al. ..... 210/170
4,793,728 A 12/1988 Ellis
5,133,619 A 7/1992 Murfae et al.
5,232,587 A 8/1993 Hegemier et al.
5,405,539 A 4/1995 Schneider
5,409,602 A * 4/1995 Sorenson ..... 210/162
5,480,254 A 1/1996 Autry et al.
5,736,035 A * 4/1998 Nurse, Jr. ..... 210/498
5,744,048 A 4/1998 Stetler
5,820,762 A 10/1998 Bamer et al.
5,849,198 A 12/1998 Sharpless
5,855,774 A 1/1999 Boelter
5,904,842 A 5/1999 Billias et al.
5,980,740 A * 11/1999 Harms et al. ..... 210/162
5,980,744 A * 11/1999 Gagnon et al. ..... 210/498
5,985,157 A 11/1999 Leckner et al.
6,051,131 A * 4/2000 Maxson ..... 210/162
6,080,307 A 6/2000 Morris et al.
6,093,314 A 7/2000 Wilson et al.
6,106,707 A 8/2000 Morris et al.
6,126,817 A 10/2000 Duran et al.
6,200,484 B1 3/2001 McInnis
6,214,217 B1 * 4/2001 Sliger, Jr. ..... 210/459
6,217,757 B1 4/2001 Fleischmann
6,231,758 B1 5/2001 Morris et al.
6,270,663 B1 8/2001 Happel
6,428,692 B2 8/2002 Happel
6,531,059 B1 3/2003 Morris et al.
6,537,446 B1 3/2003 Sanguinetti (Continued)

*Primary Examiner*—Christopher Upton
(74) *Attorney, Agent, or Firm*—Coats & Bennett, P.L.L.C.

(57) ABSTRACT

A storm drain filter is provided for filtering trash and debris from a stream of water passing through a storm drain. The storm drain filter comprises a panel having a multiplicity of openings formed therein and is adapted to mount adjacent to a sidewall of a storm drain such that the filter lies adjacent an outlet through which water passing from the storm drain flows. When installed in a storm drain, the filter fits relatively close to the outlet and the adjacent sidewall and permits water to flow through the openings thereof, but filters trash and debris.

13 Claims, 4 Drawing Sheets

U.S. PATENT DOCUMENTS 6,749,746 B2 * 6/2004 Mokrzycki ..... 210/163
6,797,162 B2 9/2004 Happel
6,869,526 B2 3/2005 Sharpless
2003/0127380 A1 7/2003 Morris et al.
2004/0164026 A1 8/2004 Manzone
2004/0226869 A1 11/2004 McClure et al.

* cited by examiner

STORM DRAIN FILTER

FIELD OF THE INVENTION

The present invention relates to storm drains, and more particularly to a filter adapted to be installed in the storm drain to filter trash and debris and prevent the trash and debris from entering an outlet pipe extending from the storm drain.

BACKGROUND OF THE INVENTION

Storm drains provide an important function in directing rain and storm water from residential, commercial and industrial areas. Typically a storm drain includes a compartment or a housing structure that sits below grade and typically includes a bottom, a surrounding sidewall, an inlet and an outlet. Typically the inlet of a storm drain is provided along a street or roadway curb. Storm drains are strategically located with respect to the surrounding elevation of land and paved areas such that water resulting from storm or rain showers will gravitate to the storm drain inlet. Of course, rain and storm water will be directed into the inlet but also trash, debris, leaves, limbs and other vegetation tend to be caught up in the flow of water and are also directed into the storm drains. This trash, debris and other unwanted objects and materials can cause serious problems. First, the debris, trash and the like tend to accumulate in the bottom of the storm drain and interfere with the flow of water through the storm drain. Eventually this debris and trash enters the storm drain outlet and is flushed into streams, creeks, rivers and other waterways.

Therefore, there is a need to provide an effective way of filtering trash and debris from water passing through a storm drain.

SUMMARY OF THE INVENTION

The present invention entails a filtering device that is adapted to be installed in a storm drain adjacent an outlet that extends from the storm drain. In one embodiment, the filtering device is disposed relatively close to the sidewall of the storm drain such that the filtering device catches trash and debris and prevents the trash and debris from flowing into the outlet leading from the storm drain.

In one particular embodiment, the filtering device includes a back portion, a pair of opposed side portions, and an open front. The back and/or side portions of the filtering device include openings for permitting water to pass therethrough. When installed in a storm drain, the open side of the filtering device lies directly adjacent a sidewall and the outlet of the storm drain. Thus, the side portions project from the sidewall while the back portion is spaced from the sidewall. Thus, the filtering device forms a perforated wall structure that extends from the sidewall and which isolates the outlet.

The present invention also entails a method of filtering trash and debris entering a storm drain. This method entails positioning a filtering device into a storm drain such that the filtering device encloses an area closely adjacent the outlet which effectively prevents trash and debris from entering the outlet.

Other objects and advantages of the present invention will become apparent and obvious from a study of the following description and the accompanying drawings which are merely illustrative of such invention.

BRIEF DESCRIPTION OF EXEMPLARY EMBODIMENT

With further reference to the drawings, the filter of the present invention is shown therein and indicated generally by the numeral 10. As will be discussed subsequently herein, filter 10 is designed to be installed in a storm drain indicated generally by the numeral 50 and shown schematically in FIGS. 4 and 5. Prior to describing the installation of the filter 10 within the storm drain 50, the filter itself will be described.

Figure 2:
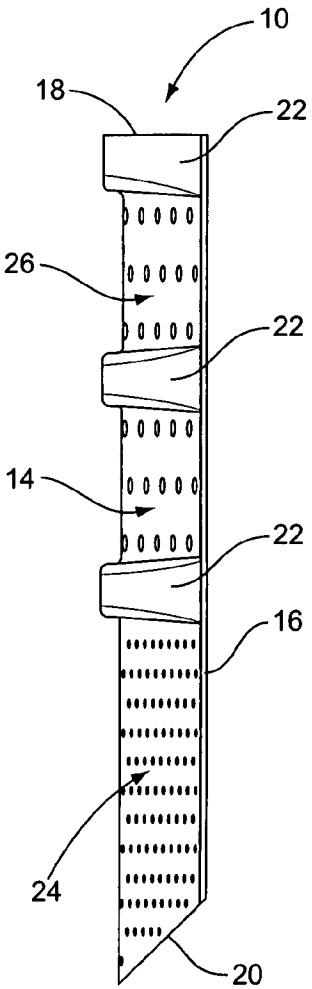
FIG. 2 is a side elevational view of the filter.
Figure 1:
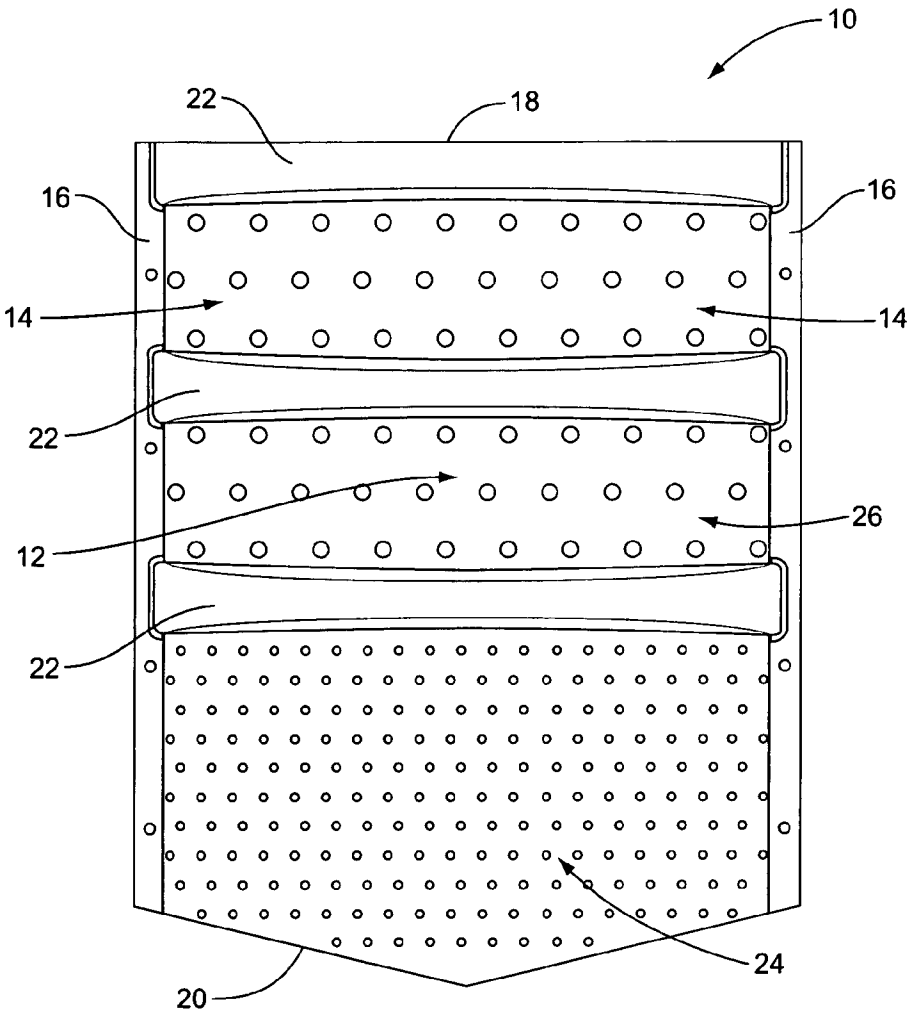
FIG. 1 is an elevational view of the filter of the present invention.
Figure 3:
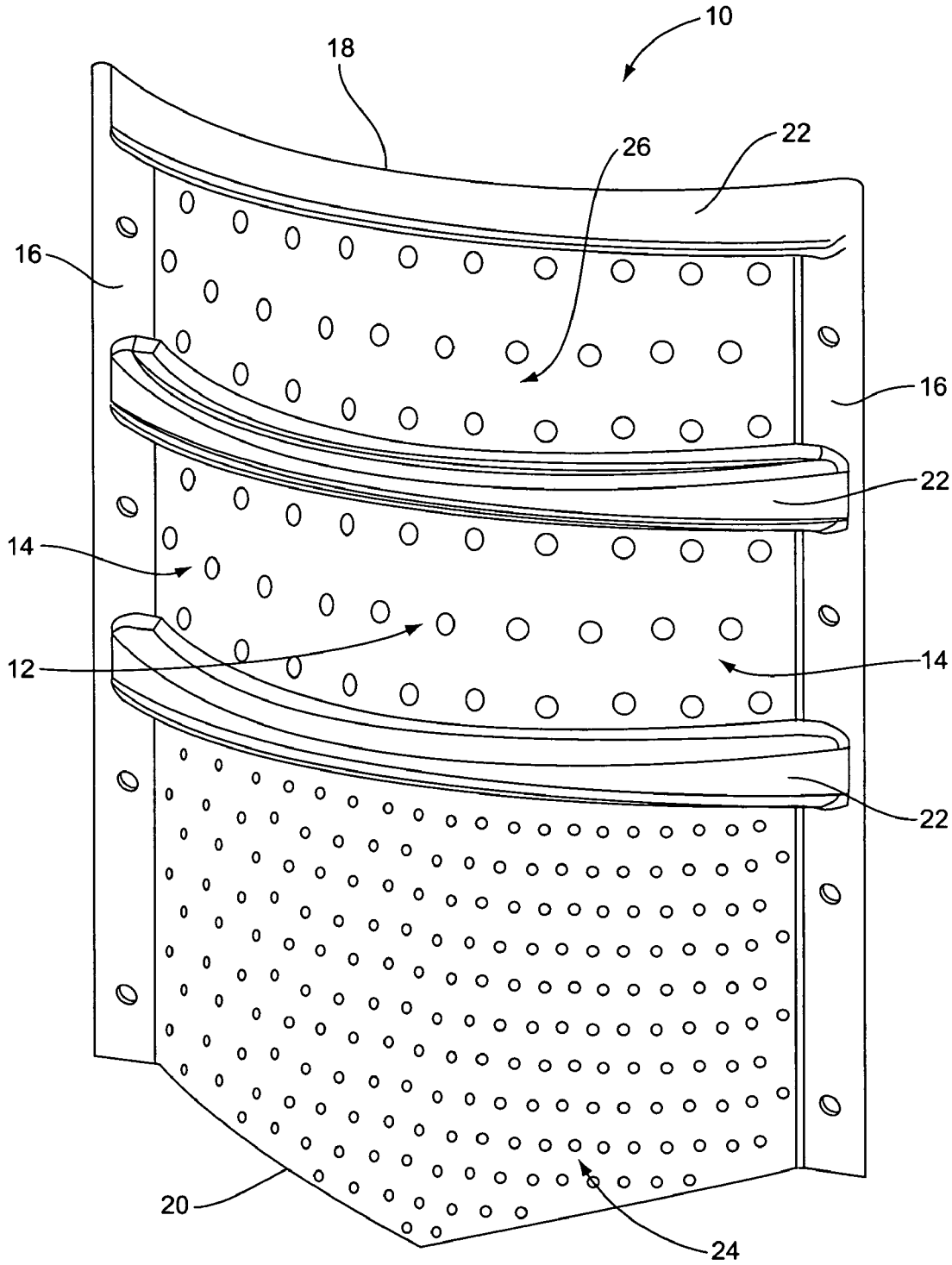
FIG. 3 is a perspective view of the filter.
Figure 4:
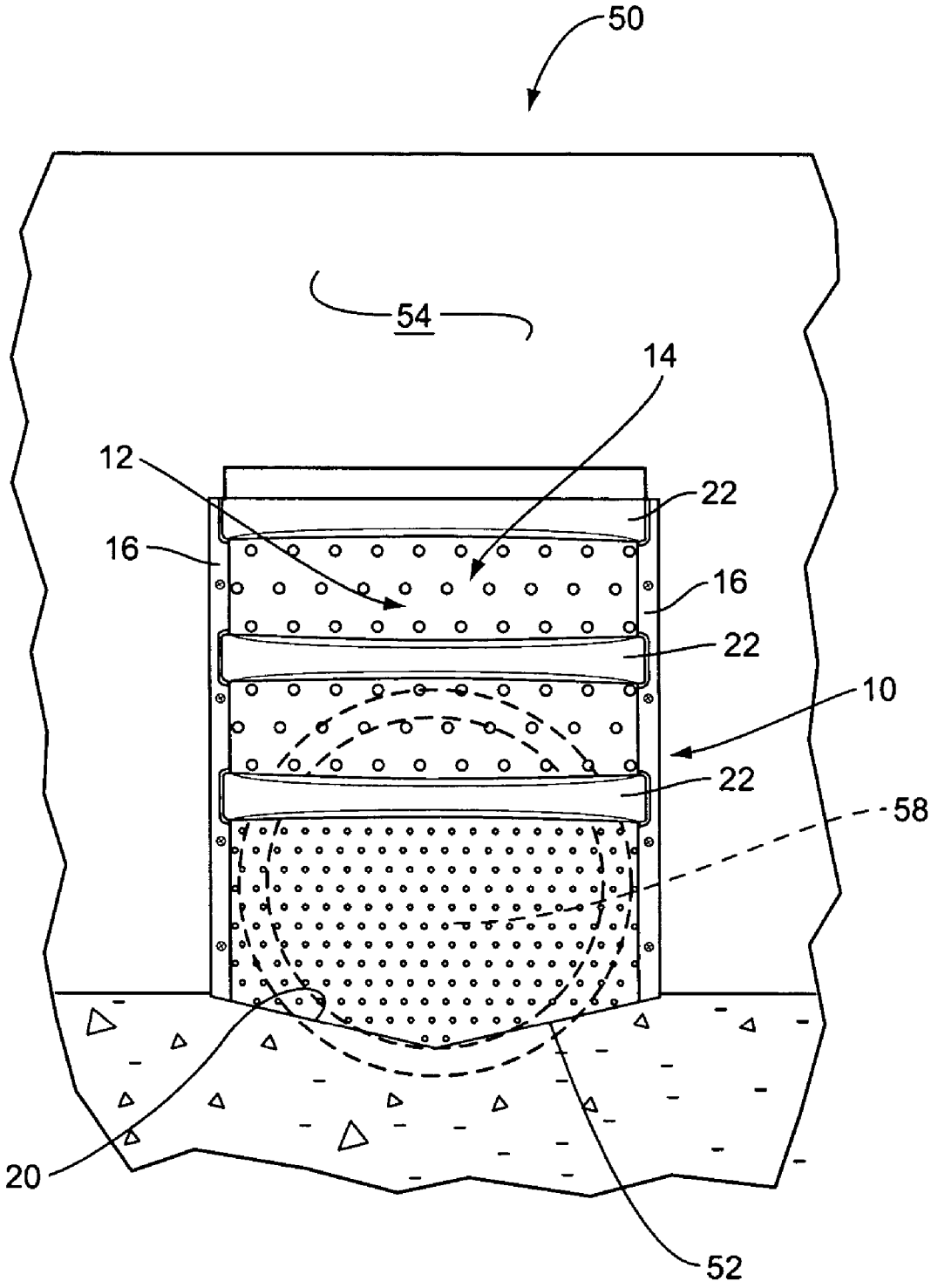
FIG. 4 is a fragmentary cross sectional view of a storm drain showing the filter of the present invention installed therein.
Figure 5:
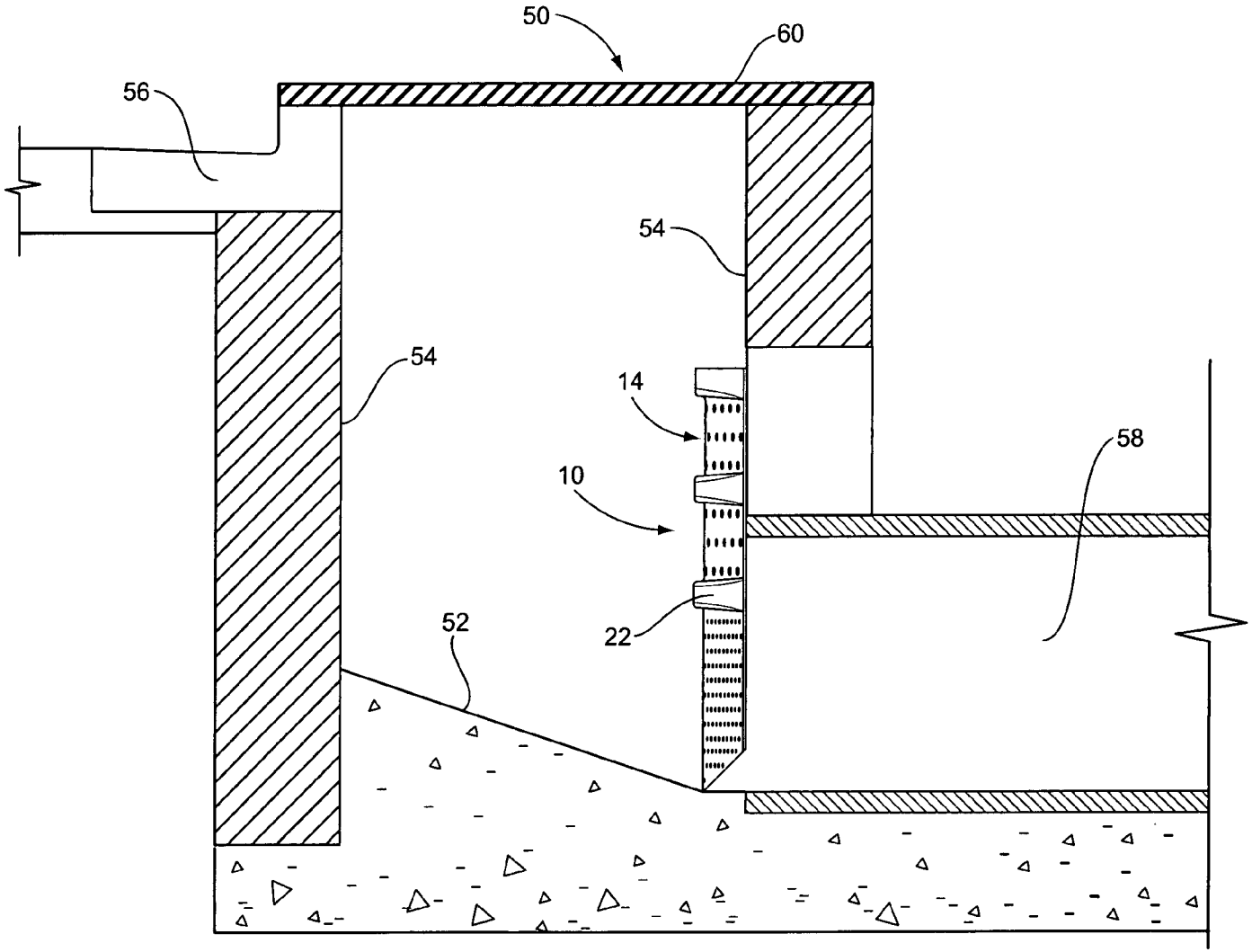
FIG. 5 is another cross sectional view of the storm drain showing the filter installed therein.

Viewing FIGS. 1-3, it is seen that the filter 10 assumes a generally curved or C-shape. Although filter 10, as shown in FIGS. 1-3, assumes a curved shape it should be appreciated that the basic shape could vary and could include various configurations such as a generally square C-shape. In any event, filter 10 is designed to be secured to a sidewall 54 of the storm drain 50. As seen in FIGS. 4 and 5, the filter 10 projects outwardly from the sidewall 54 and generally encompasses an area around an inlet 58 formed in the sidewall.

Filter 10 can be said to include a back portion or area 12 and a pair of opposed side portions 14. In the case of the embodiment shown in FIGS. 1-3, the back portion 12 and the side portions 14 form a continuous or integral construction due to the generally curved or C-shaped nature of the filter 10. However, it is appreciated, for example, that the back portion 12 and the side portions 14 could be disposed at an angle, such as a 90° angle, to each other. In any event, the filter 10 includes an open side that is designed to fit adjacent or directly to the sidewall 54 of the storm drain 50.

Disposed on each side of the filter 10 is a pair of flanges 16. In the case of the present embodiment, flanges 16 are generally flat and include an outwardly facing flat surface that abuts against the storm drain sidewall 54 when the filter 10 is installed therein. To secure the filter 10 within the storm drain 50 there is provided a series of openings in each of the flanges 16. Fasteners such as bolts or screws can be inserted through the openings into the adjacent sidewall 54 of the storm drain 50.

Filter 10 includes a series of transversely extending ribs 22. Ribs 22 extend between opposed flanges 16. In the case of the embodiment illustrated in FIGS. 1-3, there is provided three spaced apart ribs 22. However, it is appreciated that the number of ribs 22 can vary and that the filter 10 can be constructed without the incorporation of ribs.

Filter 10 includes a top 18 and a bottom 20. In the case of the particular design illustrated herein, the upper edge of the upper rib 22 forms the top edge 18. Bottom 20 in many embodiments will assume a non-linear configuration. This is because the bottom of storm drains will not be perfectly flat, especially in the area adjacent the outlet. This is because the bottom of many storm drains are particularly configured to facilitate drainage towards the outlet. Thus, similar to that illustrated in FIGS. 4 and 5, the bottom of the storm drain can assume a V or trough shape adjacent the outlet 58. Accordingly, the bottom 20 of the filter 10 is normally formed or configured to conform to the bottom of the storm drain in the area where the filter 10 is to be positioned. That is, the bottom 20 of the filter 10 is designed to set flush against the bottom of the storm drain adjacent the site of the outlet.

In order to permit water to pass through the filter 10, as shown in FIGS. 1-3, the filter 10 is provided with a multiplicity of openings. In the case of the design illustrated herein, there is provided two sets of openings, a first set indicated generally by the numeral 24 and the second set indicated generally by the numeral 26. The first set of openings 24 is disposed about a lower portion of the filter 10 while the second set of openings 26 is disposed about an upper portion of the filter 10. The size of the openings of the first set 24 is smaller than the size of the openings comprising the second set 26 and disposed about the upper portion of the filter 10. Although the size, spacing and general arrangement of these openings can vary, this design for the openings will prevent smaller objects from passing through the filter 10 about the lower portion of the filter.

Turning particularly to FIGS. 4 and 5, there is shown therein a storm drain indicated generally by the numeral 50. Storm drain 50 includes a bottom 52 and a top 60. Extending upwardly from the bottom 52 around the storm drain 50 is a sidewall 54. About an upper portion of the storm drain 50 there is formed an inlet 56. Additionally, about a lower portion of the storm drain 50 there is an outlet 58. The outlet 58 can assume various forms. In one embodiment, the outlet 58 would include a pipe that extends from one area of the sidewall 54. In conventional fashion, outlet 58 channels or directs water from the storm drain 50 downstream therefrom.

As shown in FIGS. 4 and 5, filter 10 is disposed closely adjacent the sidewall 54 in the area of the outlet 58. That is, the flanges 16 are disposed flush against the sidewall 54 and a series of fasteners extend through openings in the flanges and into the sidewall 54 to secure the filter 10 in place. Note in FIG. 4 that the bottom 52 of the storm drain 50 assumes a generally trough or V-shape adjacent the outlet 58. This, of course, facilitates the movement of water from the storm drain 50 into the outlet 58. In any event, the bottom edge 20 of the filter 10 is particularly cut or formed to conform to the shape of the bottom 52 in this area. Hence, the filter 10 can fit flush against the bottom.

The open face of the filter 10 generally lies in the plane of the flanges 16 and the flanges are generally coplanar. Thus, the back portion 12 of the filter is disposed relatively close to the sidewall 54 of the storm drain. Essentially there is a space defined between the sidewall 54 and the filter 10. Thus, it is appreciated that trash, debris and other undesirable objects are filtered by the filter 10 prior to these unwanted objects and materials entering the outlet 58. Thus, over a period of time, trash, debris and other unwanted objects will accumulate exteriorly of the filter 10. Therefore, from time to time it may be appropriate for the storm drain 50 to be cleaned. The filter 10, when installed in this manner, will prevent trash, debris and other unwanted objects and materials from passing through the storm drain 50 into the outlet 58.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A filter for a storm drain wherein the filter is designed to be installed in the storm drain and to filter trash and debris from water passing through the storm drain, the filter comprising: a perforated panel having a main section, the main section being generally curved shape and including a bottom and a top; an array of openings formed in the main section, the openings including a first lower set of openings disposed in a lower portion of the main section and a second set of openings formed in an upper portion of the main section and wherein the openings of the first set are smaller than the openings of the second set; a series of ribs formed in at least the main section, the ribs being spaced apart and extending across the main section; and a pair of side flanges disposed on opposite sides of the panel, each flange extending outwardly from the main section and including a generally flat surface for abutting against a sidewall of the storm drain.

2. A storm drain comprising:

a. an inlet for permitting water, trash and debris to enter the storm drain;

b. a bottom;

c. a sidewall;

d. an outlet for transmitting water from the storm drain, the outlet extending from the sidewall of the storm drain; and e. the filter of claim 1 mounted within the storm drain such that the main section of the panel extends closely adjacent the sidewall from which the outlet extends and effectively forms a filtering shield around the outlet and a portion of the sidewall adjacent the outlet, and wherein the flat surfaces of the flanges fit generally flush against the sidewall of the storm drain; and f. fasteners extending through the flanges into the sidewall of the drain for securing the filter directly adjacent the outlet.

3. The storm drain of claim 2 wherein in the bottom of the storm drain adjacent the outlet assumes a configuration that facilitates the drainage of water from the bottom of the storm drain to the outlet; and wherein the bottom of the main section of the filter panel is formed to conform to the configuration of the bottom of the storm drain adjacent the outlet.

4. The filter of claim 1 wherein the bottom of the main section is non-linear and includes a bottom edge that extends from one side of the filter downwardly a selected distance and then extends generally upwardly towards the other side of the filter.

5. The filter of claim 1 wherein the flanges are coplanar while the main section of the filter bows outwardly from the flanges and extends between the flanges.

6. The filter of claim 1 wherein the filter is constructed of a plastic material.

7. A storm drain filter for filtering trash and debris and generally preventing the trash and debris from entering an outlet formed in a sidewall that forms a part of a storm drain, the filter comprising: a panel having a series of holes; a back that when the filter is installed in the storm drain is spaced from the sidewall so as to form an open space between the back and the sidewall; wherein the filter includes a pair of side portions that extend towards the sidewall such that the back and side portions of a filter define an open side that lies directly adjacent the sidewall and outlet of the drain; multiple sets of holes with the size of one set of holes being larger than the size of another set of holes; and wherein the filter includes a lower portion and an upper portion and wherein the holes of the set having the larger size are disposed in the portion of the filter.

8. The storm drain filter of claim 7 wherein the filter includes series of spaced apart ribs that extend across the filter.

9. The storm drain filter of claim 7 wherein at least a portion of the back assumes a curved shape.

10. The storm drain filter of claim 7 wherein the filter assumes a generally C-shape and with the open side of the C-shaped filter is adapted to be disposed adjacent the sidewall of the storm drain.

11. A storm drain, comprising:

a. an inlet for permitting water, trash and debris to enter the storm drain;

b. a bottom forming a part of the storm drain;

c. a sidewall extending around at least a portion of the storm drain;

d. an outlet for transmitting water from the storm drain, the outlet extending from the sidewall of the storm drain;

e. a storm drain filter for filtering trash and debris and generally preventing the trash and debris from entering the outlet extending from the sidewall of the storm drain, the filter comprising a panel having a series of holes, a back that when the filter is installed in the storm drain is spaced from the sidewall so as to form an open space between the back and the sidewall, and wherein the filter includes a pair of side portions that extend towards the sidewall such that the back and side portions of the filter define an open space that lies directly adjacent the sidewall and outlet of the drain;

said filter being mounted within the storm drain such that the open side of the filter assumes a position directly adjacent the sidewall of the storm drain and directly adjacent the outlet of the storm drain such that there is an open area defined between the filter, sidewall and outlet;

f. one or more fasteners for securing the filter in place adjacent the sidewall and outlet of the storm drain;

g. wherein the bottom of the storm drain is configured to drain water to the outlet and assumes a non-linear configuration; and h. wherein the filter assumes a bottom edge that is formed to a shape that conforms with the bottom of the storm drain such that the filter fits flush against the bottom of the storm drain.

12. The storm drain of claim 11 wherein the filter includes multiple sets of holes with the size of one set of holes being larger than the size of another set of holes, and wherein the filter includes a lower portion and an upper portion, and wherein the holes of the set having the larger size are disposed in the upper portion of the filter.

13. The storm drain of claim 11 wherein the filter assumes a generally C-shape.

* * * * *